US009543704B1

(12) United States Patent
Hsu et al.

(10) Patent No.: US 9,543,704 B1
(45) Date of Patent: Jan. 10, 2017

(54) POWER ADAPTER

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Li-Pin Hsu, New Taipei (TW); Wei-Hsi Chen, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/954,978

(22) Filed: Nov. 30, 2015

(30) Foreign Application Priority Data

Nov. 5, 2015 (TW) ..... 104136400 A

(51) Int. Cl.

| | |
|---|---|
| ***H01R 29/00*** | (2006.01) |
| ***H01R 13/645*** | (2006.01) |
| ***H01R 24/28*** | (2011.01) |
| *H01R 103/00* | (2006.01) |

(52) U.S. Cl.
CPC ..... *H01R 13/645* (2013.01); *H01R 24/28* (2013.01); *H01R 2103/00* (2013.01)

(58) Field of Classification Search
CPC ..... H01R 27/00; H01R 13/514; H01R 13/508; H01R 13/64
USPC ..... 439/518, 172, 173, 131
See application file for complete search history.

(56) References Cited

U.S. PATENT DOCUMENTS 4,922,178 A * 5/1990 Matuszewski ..... H01M 2/1022 320/111
4,997,381 A * 3/1991 Oh ..... H01R 27/00 439/131
5,624,270 A * 4/1997 Blanchot ..... H01R 13/4534 439/136
5,634,806 A * 6/1997 Hahn ..... H01R 27/00 439/172
5,684,689 A * 11/1997 Hahn ..... H01R 13/6675 363/146
5,713,749 A * 2/1998 Wu ..... H02J 7/0042 439/131

(Continued)

FOREIGN PATENT DOCUMENTS

| | | |
|---|---|---|
| CN | 203553457 U | 4/2014 |
| TW | M408173 U1 | 7/2011 |
| TW | M461255 U1 | 9/2013 |

*Primary Examiner* — Abdullah Riyami
*Assistant Examiner* — Vladimir Imas
(74) *Attorney, Agent, or Firm* — Zhigang Ma

(57) ABSTRACT

A power adapter includes a body, a plug, and an operation board. The plug is detachably received in and electrically connected to the body. The plug has an engagement slot. The operation board is rotatably received in the body and includes a hook, a pressing portion and a pop portion. The hook latches to the engagement slot to secure the plug to the body. The pressing portion is pressed by external forces. The pop portion is positioned below the plug. When the pressing portion receives an external force, the pressing portion rotates towards the body and drives the pop portion to rotate away from the body, whereby the pop portion pops up the plug from the body.

10 Claims, 5 Drawing Sheets

(56) References Cited

U.S. PATENT DOCUMENTS 5,906,509 A * 5/1999 Wu ..... H01R 29/00 439/518
6,059,584 A * 5/2000 Mareno ..... H01R 35/04 439/131
6,086,395 A * 7/2000 Lloyd ..... H01R 13/6675 363/146
6,227,888 B1 * 5/2001 Hahn ..... H01R 27/00 439/172
6,270,364 B1 * 8/2001 Wang ..... H01R 31/065 439/131
6,851,961 B2 * 2/2005 Lin ..... H01R 31/06 439/221
6,893,297 B2 * 5/2005 Chen ..... H01R 31/06 439/680
7,354,286 B1 * 4/2008 Lee ..... H01R 13/652 439/131
7,445,513 B1 * 11/2008 Lee ..... H01R 31/06 439/131
7,547,219 B2 * 6/2009 Zhuge ..... H01R 13/4534 439/173
7,621,765 B1 * 11/2009 Wu ..... H01R 31/06 439/173
7,753,721 B1 * 7/2010 Wu ..... H01R 13/6275 431/131
7,794,251 B2 * 9/2010 Wen ..... H01R 13/514 320/111
7,798,825 B1 * 9/2010 Pai ..... H01R 31/06 439/131
8,087,946 B2 * 1/2012 Namiki ..... H01R 31/06 439/170
8,215,976 B2 * 7/2012 Peng ..... H01R 31/06 439/173
8,309,366 B2 * 11/2012 Buchanan ..... B01L 3/5029 422/400
8,382,526 B2 * 2/2013 Chen ..... H01R 13/639 439/173
9,166,351 B1 * 10/2015 Wang ..... H01R 27/00
2012/0021653 A1 1/2012 Chen et al.

* cited by examiner

POWER ADAPTER

FIELD

The subject matter herein generally relates to a power adapter, and particularly relates to a power adapter conveniently changing a connector.

BACKGROUND

Different places in the world use different sockets and plugs since there are different voltages and security requirements in different places. Normally, a plug of a power adapter can be only applied to one type of socket, which may cause troublesome when user travelling internationally.

BRIEF DESCRIPTION OF THE DRAWINGS

Implementations of the present technology will now be described, by way of example only, with reference to the attached figures.

DETAILED DESCRIPTION

Figure 1:
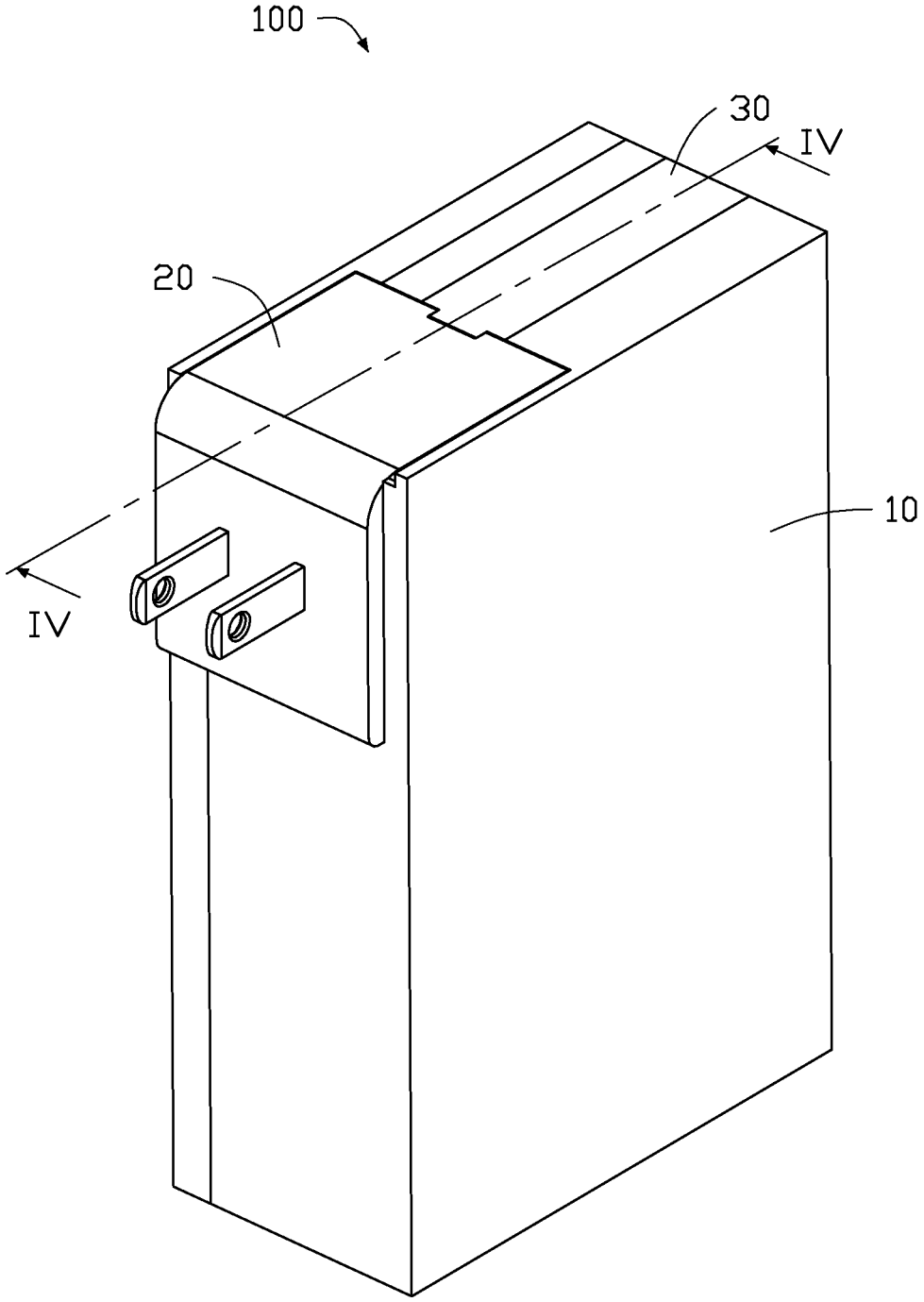
FIG. 1 is an isometric view of an exemplary embodiment of a power adapter.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

FIG. 1 illustrates an exemplary embodiment of a power adapter 100, which is configured to be coupled to a power socket to charge for an electronic device. The power adapter 100 includes a body 10, a plug 20, and an operation board 30.

Figure 2:
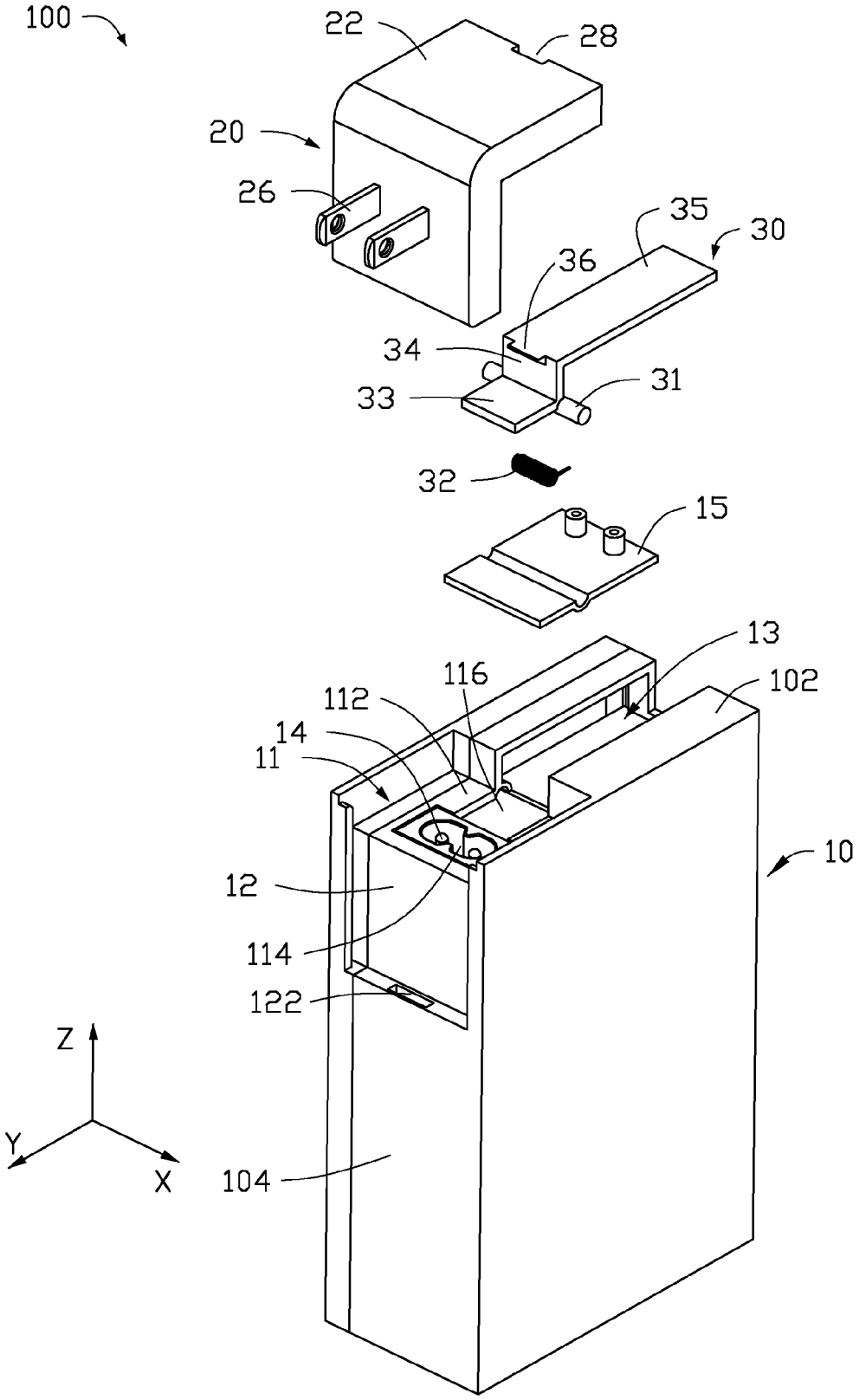
FIG. 2 is an exploded view of the power adapter of FIG. 1.

Referring to FIG. 2, the body 10 includes a first groove 11, a guiding slot 12, a second groove 13, a pair of conductive columns 14 and a fixing board 15. The body 10 further includes a top surface 102 and a side surface 104 adjacent to the top surface 102. A portion of the top surface 102 recesses to form the first groove 11. In at least one embodiment, the first groove 11 is substantially square and includes a bottom wall 112. A first receiving groove 114 and a second receiving groove 116 are formed by recessing from the bottom wall 112. The first receiving groove 114 is adjacent to the second receiving groove 116. The conductive columns 14 are received in the first receiving groove 114 in parallel and configured to electrically connect the plug 20 and a circuit board (not shown) of the body 10.

The guiding slot 12 is formed by recessing a portion from the side surface 104. The guiding slot 12 is communicated with the first groove 11. An end surface of the guiding slot 12 away from the first groove 11 defines a hole 122. The second groove 13 is formed by recessing a portion from the top surface 102 and communicated with the first groove 11. In at least one embodiment, the second groove 13 is substantially rectangular. The second groove 13 has a smaller width and a greater depth than that of the first groove 11. A lower portion of the second groove 13 extends to a below of the first groove 11 and adjacent to the second groove 116. The fixing board 15 is mounted on a bottom of the second groove 13 and extends to a below of the bottom wall 112, while a portion of the fixing board 15 is exposed by the second groove 116. The fixing board 15 is configured to secure the operation board 30.

Figure 3:
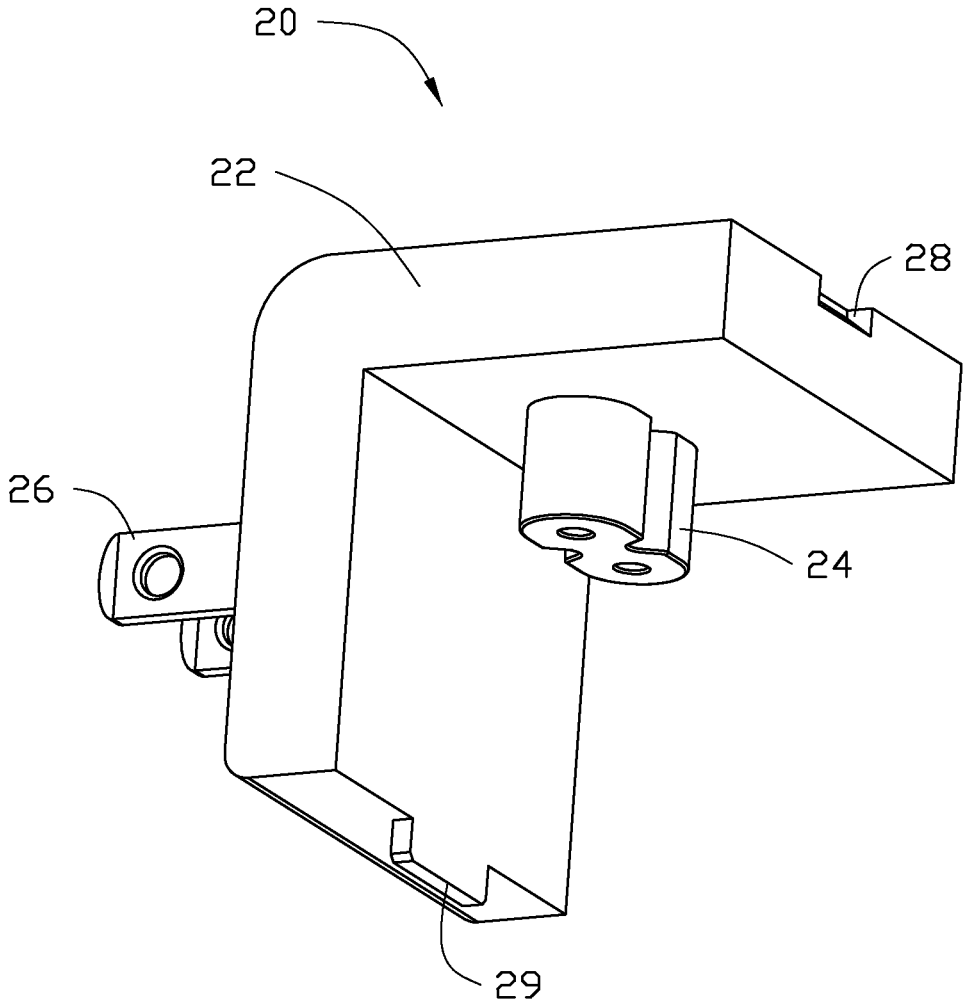
FIG. 3 is an isometric view of a plug of the power adapter of FIG. 2.

Referring to FIGS. 2 and 3, the plug 20 includes a main portion 22, a conductive portion 24, pins 26, an engagement slot 28, and a protrusion 29. The main portion 22 is substantially L-shaped and detachably received in the first groove 11 and the guiding slot 12. The conductive portion 24 is substantially column shaped and formed by protruding from an internal surface of the main portion 22. The conductive portion 24 is received in the first receiving groove 114 and electrically connected to the conductive columns 14. The conductive portion 24 defines conductive holes (not shown) for receiving the conductive columns 14. In at least one embodiment, the plug 20 includes two conductive portions 24 for receiving the conductive columns 14. The pins 26 are formed by protruding from an end of the main portion 26 away from the conductive portion 24. The pins 26 are configured to be coupled to the socket for conducting electricity. In at least one embodiment, the conductive columns 14 extend along a Z-axis direction and the pins 26 extend along a Y-axis direction. The engagement slot 28 is defined on an end of the main portion 22 and adjacent to the conductive portion 24. The engagement slot 28 is configured to secured the operation board 30. The protrusion 29 is formed by protruding from an end of the main portion 22 away from the engagement slot 28 and configured to be coupled to the hole 122 for securing an end of the main portion 22 to the body 10.

A quantity of the pins 26 and a structure of the pins 26 can be multiple, which can be adapted to different standard sockets in different places. In at least one embodiments, the quantity of the pins 26 can be two and the structure can be substantially rectangular sheet.

Figure 4:
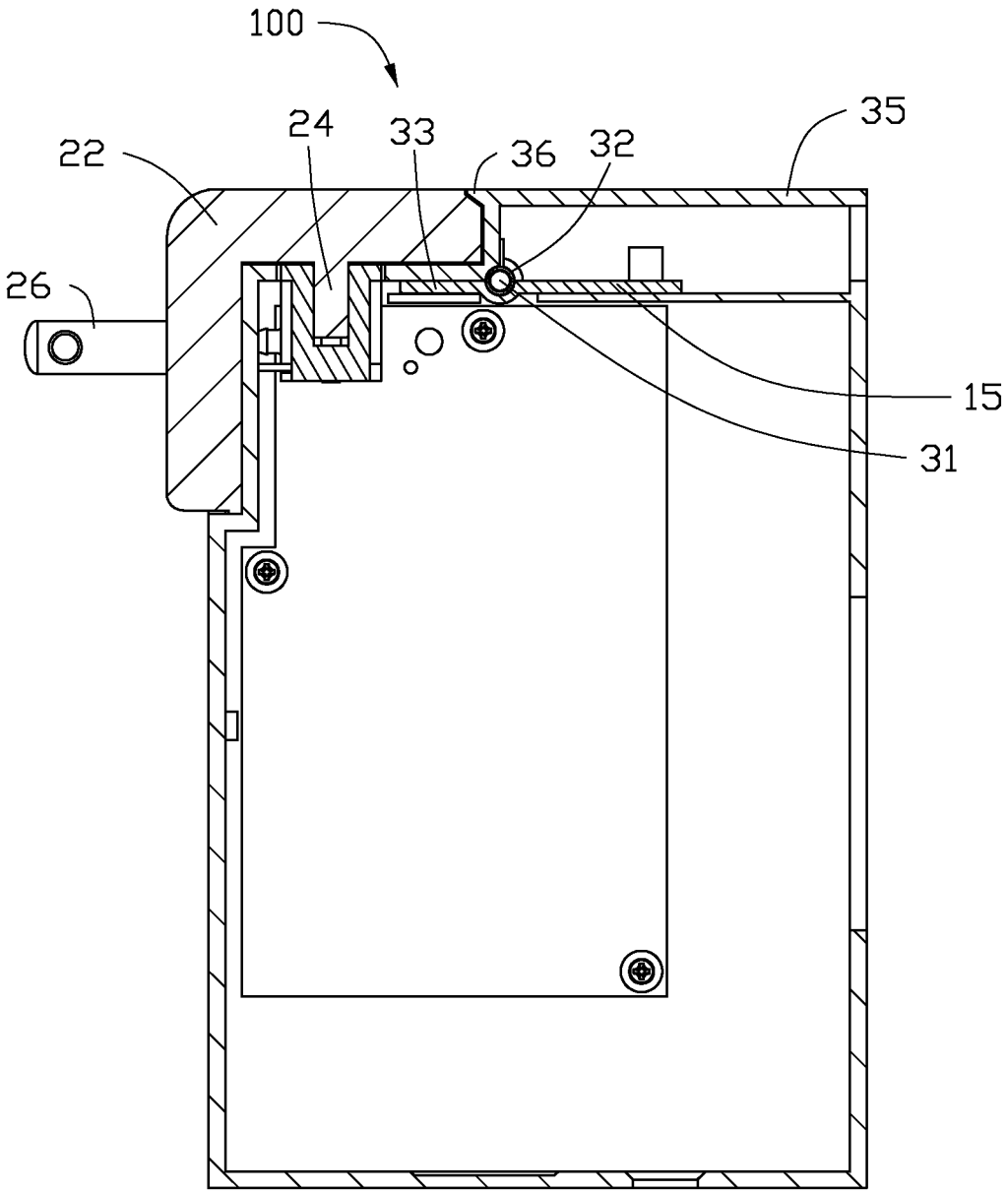
FIG. 4 is a cross-sectional view of the power adapter of FIG. 1.

Referring to FIGS. 2, 3, and 4, the operation board 30 is substantially ladder-shaped and includes a shaft 31, an elastic piece 32, a pop portion 33, a connecting portion 34 and a pressing portion 35. The shaft 31 is mounted between the fixing board 15 and the bottom wall 112. The pop portion 33 and the pressing portion 35 are perpendicularly connected to opposite ends of the connecting portion 34 and extend in opposite directions. The end of the connecting portion 34 connecting the pop portion 33 is secured to the shaft 31, while the other end connecting the pressing portion 35 forms a hook 36. The hook 36 is configured to latch to the engagement slot 28 to limit a movement of the plug 20 in a Z-axis direction, thereby preventing the plug 20 falling off from the body 10. The elastic piece 32 hitches the shaft 31 and is elastically resisted to the connecting portion 34 and the fixing board 15. Thus, the operation board 30 can rotate corresponding to the body 10 based on the shaft 31, and the elastic piece 32 provides an elastic restoring force. The pop portion 33 is received in the second receiving groove 116 and adjacent to the first receiving groove 114. The pop portion 33 is coplanar with the bottom wall 112 is configured to pop up the plug 20. The pressing portion 35 is configured to be pressed by the user. In at least one embodiment, the operation board 30 can be formed by plastic injection molding.

In manufactory, the operation board 30 is received in the second groove 13, the pop portion 33 is received in the second receiving groove 116. The pop portion 33 and the shaft 31 are mounted the fixing board 15, the elastic piece 32 hitches the shaft 31 and is elastically resisted to the connecting portion 34 and the fixing board 15. The pressing portion 35 is coplanar with the top surface 102 of the body and capable of rotating in the second groove 13 circumfusing the shaft 31. The plug 20 slides along the guiding slot 12 to be received in the first groove 11 and the guiding slot 12. The protrusion 29 is engaged to the hole 122 to secured an end of the plug 20 to the body 10. The conductive portion 24 is received in the first receiving groove 114 and electrically connected to the conductive columns 14. The pins 26 extend outwardly for being connected to the socket. The engagement of the conductive portion 24 and the first receiving groove 114 and the engagement of the protrusion 29 and the hole 122 can limit a movement of the plug 20 in the X-axis and the Y-axis directions. The end of the main portion 22 having the engagement slot 28 is overlapped above the pop portion 33, the hook 34 latched to the engagement slot 28 to secure the plug 20 on the body 10.

Figure 5:
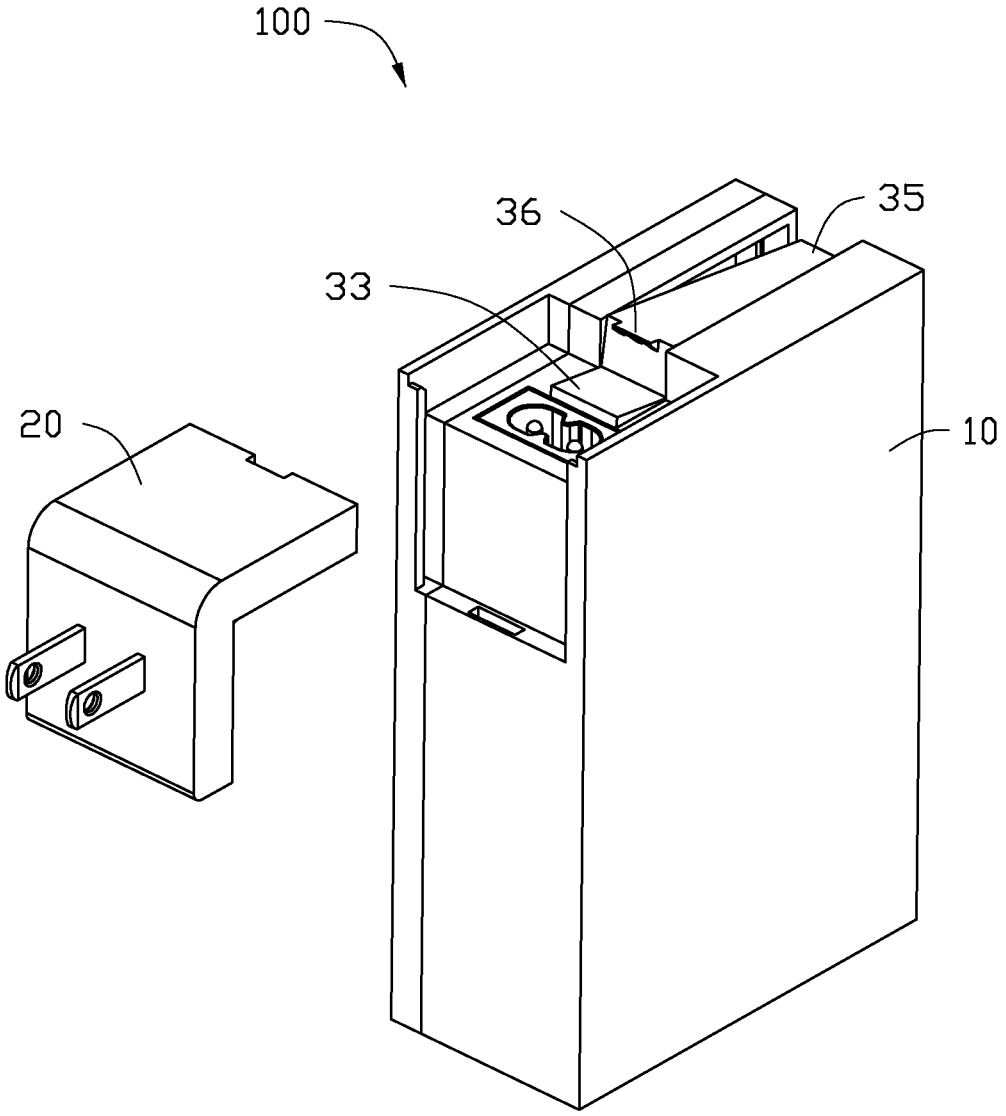
FIG. 5 is an isometric view of the power adapter in another state.

Referring to FIG. 5, when the user need to change the plug 20 to adapt to different standard sockets, may press the pressing portion 35 to force the pressing portion 35 to rotate towards the fixing board 15. The pop portion 33 rotates away from the fixing board 15 to push the main portion 22, thus the hook 36 detaches from the engagement slot 28, therefore, the pop portion 33 pops up the plug 20. Then another plug 20 with different standard pins 26 can be changed to the body 10.

The power adapter 100 can easily secure and pop up the plug 20 via the operation board 30, thus, the power adapter 100 can conveniently change different standard plugs 20 to be adapted to different standard sockets, which has a great universality and practicability.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. A power adapter configured to be connected to a power socket, the power adapter comprising:

a body;

a plug detachably received in and electrically connected to the body, the plug having an engagement slot on one end; and an operation board rotatably received in the body, the operation board comprising:

a hook latchable to latch to the engagement slot to secure the plug to the body;

a pressing portion configured to be pressed by external forces; and a pop portion positioned below the plug;

wherein when the pressing portion receives an external force, the pressing portion rotates towards the body and drives the pop portion to rotate away from the body, whereby the pop portion pops up the plug from the body.

2. The power adapter as claimed in claim 1, wherein the body comprises a first groove, a guiding slot and a second groove, the first groove and the second groove are formed by recessing adjacent portions from a top surface of the body, the first groove is communicated with and adjacent to the second groove, the second groove has a smaller width and a greater depth than that of the first groove, a lower portion of the second groove extends to a below of the first groove; the guiding slot is formed on a side surface adjacent to the top surface, the guiding slot is communicated with the first groove.

3. The power adapter as claimed in claim 2, wherein the first groove comprises a bottom wall, the bottom wall further recesses to form adjacent a first receiving groove and a second receiving groove, the body further comprises a pair of conductive columns and a fixing board, the conductive columns are received in the first receiving groove, the fixing board is received in the second groove and mounted on a bottom of the second groove, the fixing board extends to below of the bottom wall of the first groove and is partially exposed by the second receiving groove.

4. The power adapter as claimed in claim 3, wherein the plug comprises a main portion, a conductive portion and pins, the main portion is substantially L-shaped and detachably received in the first groove and the guiding slot, the conductive portion is substantially column shaped and formed by protruding from an internal surface of the main portion, the conductive portion is received in the first receiving groove and electrically connected to the conductive columns; the pins are formed by protruding from an end of the main portion away from the conductive portion, the pins configured to be coupled to the socket for conducting electricity.

5. The power adapter as claimed in claim 4, wherein the plug comprises two conductive portions for receiving the conductive columns, the conductive portion defines conductive holes for receiving the conductive columns.

6. The power adapter as claimed in claim 5, wherein the operation board is formed by plastic injection molding.

7. The power adapter as claimed in claim 4, wherein a quantity of the pins and a structure of the pins are multiple.

8. The power adapter as claimed in claim 4, wherein the operation board further comprises a connecting portion, a shaft and an elastic portion, the pop portion and the pressing portion are perpendicularly connected to opposite ends of the connecting portion and extend in opposite directions; the shaft is defined on the end of the connecting portion connecting the pop portion, the shaft and the pop portion are both mounted on the fixing board, the pop portion is received in the second receiving groove and coplanar with the bottom wall of the first groove, the pressing portion is coplanar with the top surface of the body, the elastic piece hitches the shaft and elastically resisted to the fixing board and the connecting portion.

9. The power adapter as claimed in claim 8, wherein the engagement slot is defined on an end of the main portion connecting the conductive portion, another end of the main portion away from the engagement slot defines a protrusion, an end surface of the guiding slot away from the first groove defines a hole, when the plug is received in the body, the protrusion is coupled to the hole, the hook latches to the engagement slot, thus, the plug is secured to the body.

10. The power adapter as claimed in claim 9, wherein when the pressing board receives external force and rotates towards the fixing board, the operation board rotates in the second groove circumfusing the shaft, the pop portion rotates away from the fixing board to push the main portion, the hook detaches from the engagement slot, therefore, the pop portion pops up the plug, the elastic piece provides an elastic restoring force for the operation board.

* * * * *